United States Patent [19]

Grove

[11] Patent Number: 4,972,749

[45] Date of Patent: Nov. 27, 1990

[54] CALIBRATED FENCE FOR RADIAL ARM SAWS

[76] Inventor: James S. Grove, 6 Dominguez St., Laguna Hills, Calif. 92656

[21] Appl. No.: 459,524

[22] Filed: Jan. 2, 1990

[51] Int. Cl.[5] ..... B26D 7/01; B26D 7/28

[52] U.S. Cl. ..... 83/468.2; 83/468.4; 83/468.6; 83/468.7; 83/522.18; 83/522.25; 269/303; 269/307; 269/317

[58] Field of Search ..... 83/468, 468.1, 468.2, 83/468.4, 522.18, 522.19, 522.25, 468.5, 468.6; 269/303, 304, 315, 316, 317, 319, 307

[56] References Cited

U.S. PATENT DOCUMENTS

| | | | |
|---|---|---|---|
| 615,991 | 12/1898 | Ingman | 269/303 |
| 869,309 | 10/1907 | Kramer | 269/315 X |
| 957,779 | 5/1910 | Leaver, Jr. | 269/303 |
| 957,780 | 5/1910 | Leaver, Jr. | 269/317 |
| 1,737,131 | 11/1929 | Tompkins | 269/315 |
| 3,116,658 | 1/1964 | Baker | 83/468.5 X |
| 3,864,996 | 2/1975 | Morgolenko et al. | 83/468.5 X |
| 4,224,854 | 9/1980 | Malacheski et al. | 83/455 X |
| 4,256,000 | 3/1981 | Seidel | 83/468.4 X |
| 4,397,598 | 8/1983 | Ess et al. | 83/468.2 X |
| 4,412,468 | 11/1983 | Bucy | 269/303 X |

*Primary Examiner*—Frank T. Yost
*Assistant Examiner*—Kenneth E. Peterson
*Attorney, Agent, or Firm*—Francis X. Lojacono

[57] ABSTRACT

A calibrated fence apparatus for radial arm saws wherein the calibrated fence apparatus consists of one of more fence units secured to the saw table top whereby a workpiece to is positioned against the apparatus so as to be cut at a selected length which is set by the adjustment of a plurality of stop gauge members that are slidably mounted in the housing of the fence units. The stop gauge members are adapted to be releasably locked in a fully retracted position when a given measured setting is required for cutting several workpieces in an accurate and speedy manner.

9 Claims, 2 Drawing Sheets

CALIBRATED FENCE FOR RADIAL ARM SAWS

BACKGROUND OF THE INVENTION

1. Field of the Invention

The present invention relates to a measuring device and more particularly to a calibrated fence apparatus adapted for use with a radial arm saw.

2. Description of the Prior Art

As is well known in the art, various problems and difficulties are encountered in providing suitable means for accurately cutting lumber, wood pieces and boards to a given measurement in a continuous operation. To simplify the further description thereof, the word "workpiece" will be employed to represent items that are normally cut on radial arm saws.

Radial arm saws include a table over which a saw blade is positioned for cutting the workpiece. The table is provided with a wood fence located adjacent the rear edge against which the workpiece is positioned. Some fence devices are made of metal. However, both the wood and metal fences are commonly provided with either measured markings or tape measures attached thereto. The stop devices that are used to fix given measurements vary, but are generally such that they must be clamped or locked in place at a selected measurement along the fence. Such stop devices are time consuming and if not properly secured can move enough to cause some workpieces to be cut at a slightly different measurement than required. This can be a costly problem when the workpieces consist of very expensive wood. It is also costly for cabinet shops, both in production and custom woodworking, as well as for the home hobbiest.

OBJECTS AND ADVANTAGES OF THE INVENTION

The present invention defines a calibrated fence apparatus that is readily adapted for use with most types of radial arm saws wherein the fence is secured along the length of the saw table adjacent the rear by an elongated housing having a square or rectangular cross-sectional configuration with a multiplicity of contiguously arranged compartments, wherein the front face of the housing is formed with a slot or opening to each compartment. Each compartment is provided with a stop gauge member that is spring-loaded whereby the stop gauge extends outwardly from the face of the housing when not locked in a retracted mode. This arrangement of the stop gauges allows each gauge member to be forced inwardly and locked in a retracted position by means of a rear flexible hook. However, the stop gauge members are arranged to be forced inwardly to a flush position with that of the front face of the housing without causing the stop gauge to lock. This arrangement allows a cut to be made on a single workpiece.

Accordingly, it is an object of the present invention to provide a calibrated fence apparatus that can be set at a given measurement for cutting several workpieces in a very accurate and speedy manner heretofore not possible in the art known to the inventor of the present invention.

Another object of the invention is to provide a calibrated fence apparatus that is designed to be employed with all known radial arm saw tools and wherein the length of each fence housing is calibrated along the top surface thereof for simple, accurate and fast reading for setting the proper stop gauges in their retracted position.

A further object of the invention is to provide a fence for cutting workpieces that includes attaching connector ends whereby a plurality of fence housing can be interconnected end-to-end when workpieces are to be cut at lengths greater than the normal length of the saw table. The length of the calibrated housing will vary from one foot to twelve feet with different lengths being joined together as might be needed. That is, two six feet lengths can be joined together to form a twelve-feet unit, or one-eight feet length connected to a ten-feet length provides an overall eighteen-feet length calibrated fence.

A still further object of the present invention is to provide an apparatus of this character that includes automatic spring-loaded stop gauge members that are slidably mounted in each contiguous compartment formed in the fence housing, the stop gauge members being located every half inch apart. This arrangement allows for a cut setting in increments of one half inch. However, when fractions of an inch are required (such as $\frac{1}{8}''$, $\frac{1}{4}''$, $\frac{5}{8}''$, $\frac{3}{4}''$, and $\frac{7}{8}''$) an optional slide stop gauge is employed for such measured settings.

It is still another object of the present invention to provide a calibrated fence apparatus of this character that has few working parts and is easy to use, service and maintain.

It is still a further object of the invention to provide a device of this character that is relatively inexpensive to manufacture and is simple but rugged in construction.

The characteristics and advantages of the invention are further sufficiently referred to in connection with the accompanying drawings without departing from the principles disclosed and I contemplate the employment of any structures, arrangements or modes of operation that are properly within the scope of the appended claims.

BRIEF DESCRIPTION OF THE DRAWING FIGURES

With the above and related objects in view, the invention consists in the details of construction and combination of parts, as will be more fully understood from the following description, when read in conjunction with the accompanying drawings and numbered parts, in which.

DETAILED DESCRIPTION OF THE INVENTION

Figure 1:
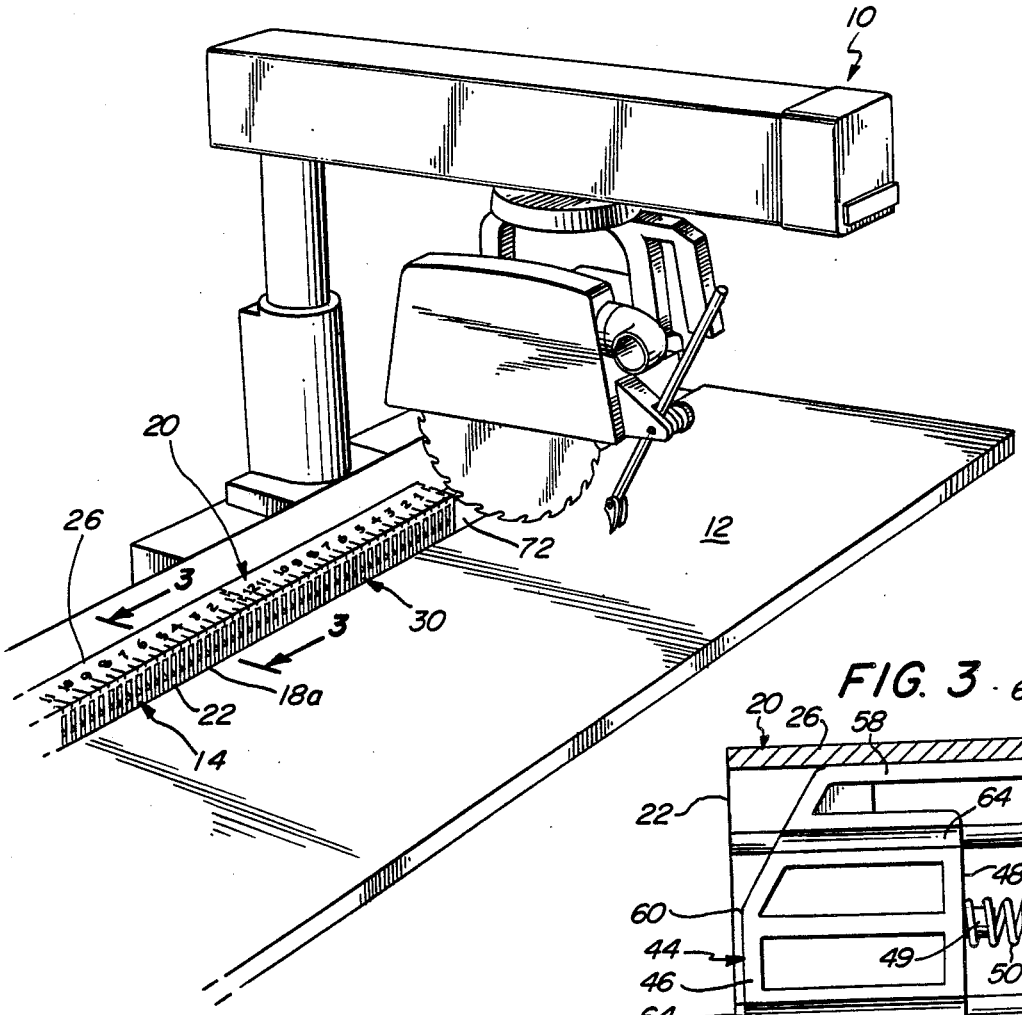
FIG. 1 is a pictorial view of a typical radial arm saw having the new calibrated cutting fence mounted on the saw table in the suggested manner.

Referring more particularly to FIG. 1, there is shown a pictorial view of a typical radial arm saw, generally indicated at 10, having a table 12 on which a workpiece to be cut is supported. The present invention, that being a calibrated fence apparatus, designated generally at 14, is illustrated mounted to table 12. Further, one may refer to FIG. 2, which is a partial top plan of radial saw 10, which includes table 12 and the calibrated fence apparatus 14 with a workpiece (board) 16 lying on the table and positioned against the fence apparatus. The calibrated fence apparatus 14 is shown having two fence units 18 and 18*a* so as to further illustrate how two or more fence units are connected together as needed. The one-foot fence units are examples only, as each unit will vary in length from three to ten feet or more. The length thereof will depend on a specific operation.

The fence units may be constructed of any suitable material such as various metals, plastics or combinations thereof.

Figure 3:
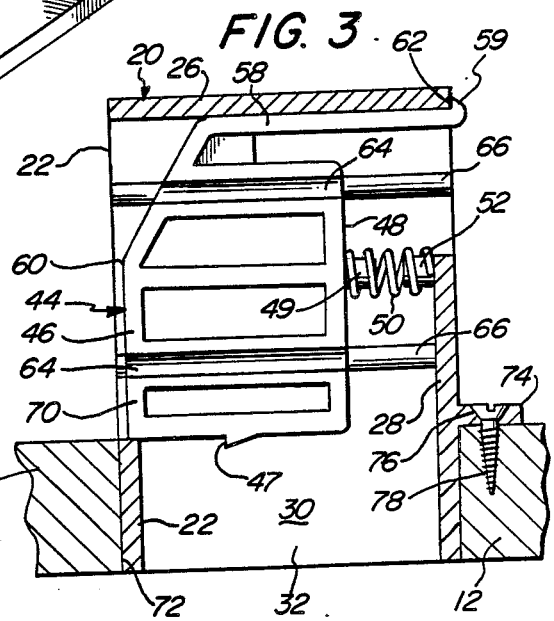
FIG. 3 is an enlarged cross-sectional view of the fence housing showing the stop gauge in a secure retracted position with the sectional view being taken substantially along line 3—3 of FIG. 1.
Figure 4:
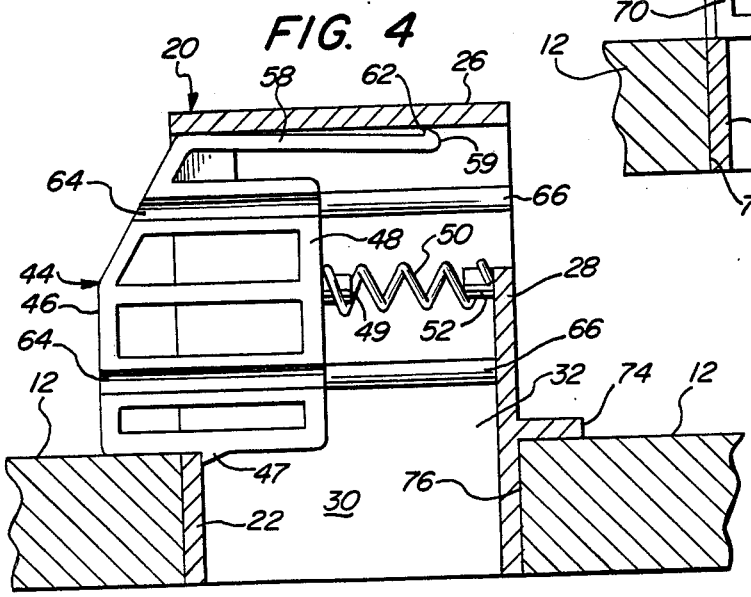
FIG. 4 is a cross-sectional view similar to that shown in FIG. 3, but with the stop gauge member being positioned in a fully extended mode.

More specifically, each fence unit 18 and 18*a* is formed as an elongated housing 20 having a substantially square or rectangular cross-sectional configuration, as indicated in FIG. 3 and 4. The front wall 22 is provided with a plurality of slots or rectangular openings 24 that are arranged in a juxtaposed vertical arrangement with each other and spaced one-half inch apart so as to correspond to the measured markings of the scale 25 imprinted in the surface of the housings. Housing 20 is defined by front wall 22, a top wall 26, a rear wall 28, and end walls 34 and 36. Rear wall 26 is also provided with openings or slots 29 which are in alignment with the oppositely disposed calibrated slots 24. Slots 24 define openings into respective compartments designate at 30. Each compartment 30 is defined by walls 22, 26, 28 and an intermediate partition 32.

Figure 2:
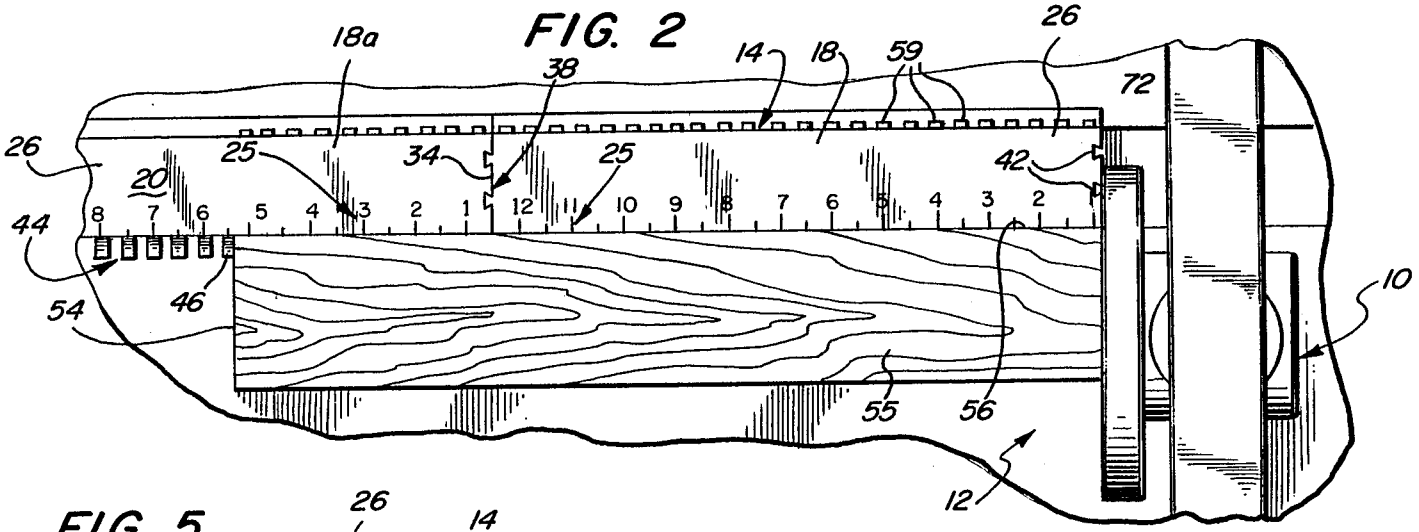
FIG. 2 is a top plan view of the fence and saw showing a workpiece being positioned and cut by the radial arm saw.
Figure 5:
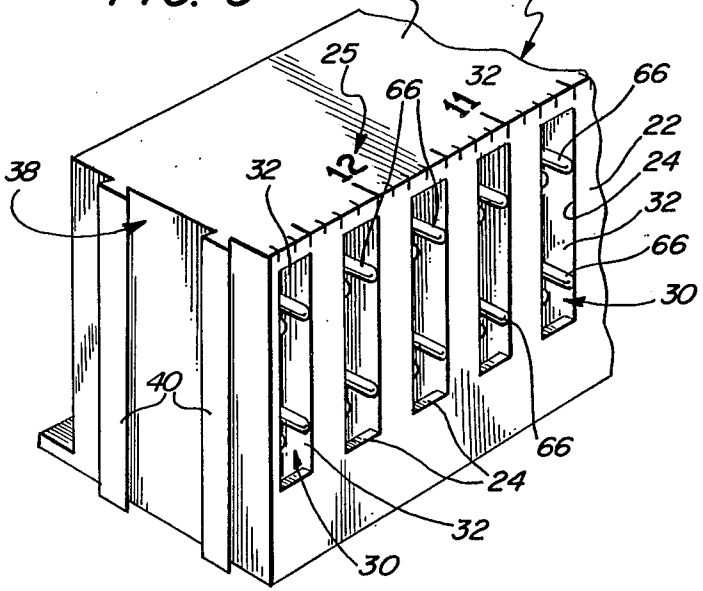
FIG. 5 is and enlarged perspective view of one end of the fence housing showing the connecting tongue member and the juxtaposed compartments.

End walls 34 and 36 are provided with interconnecting means, designate at 38, which can be formed in any suitable arrangement but is herein shown as a tongue-and-groove interlocking means, with the left end wall 34 having a pair of parallel tongue members 40 and the right end wall 36 having a pair of corresponding grooves 42, as seen in FIGS. 2 and 5. Thus, two or more fence units can be secured together at their respective ends as needed.

Figure 6:
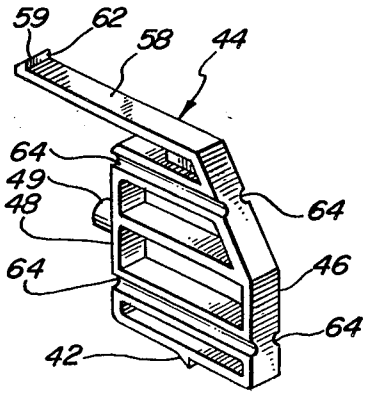
FIG. 6 is a perspective view of a stop gauge member that is slidably mounted in the slotted compartment.

Referring now to FIGS. 3, 4 and 6, there is shown a gauge means which comprises a stop gauge member 44 having a configuration that allows it to be slidably mounted within compartment 32. Stop gauge member 44 is formed having a front extension portion 46 and a rear portion 48 that includes a projection pin 49 to support one end of coil spring 50 which defines a biasing means between stop member 44 and the rear wall 28. Wall 28 is also provided with a spring support pin 52. When in a non-operating mode, as illustrated in FIG. 4, stop member 44 is extended outwardly from a compartment 30 by means of spring 50. However, stop member 44 includes a limiting means defined by a shoulder stop member 46 formed along the bottom portion thereof so as to engage front wall 22, as seen in FIG. 4. Thus, the front portion 46 of stop member 44 extends so it will be engaged by the forward edge 54 of workpiece 55, as illustrated in FIG. 2.

FIG. 2 also illustrates the longitudinal edge 56 of workpiece 55 as abutting the face of front wall 22. Fence members 18 and 18*a* are shown set to cut workpiece 55 at a given length of 17½ inches. Accordingly, any number of workpieces can now be cut to the exact length accurately with ease.

To establish a given calibration a select number of stop gauge members must be locked into a retracted position as seen in FIG. 3. Thus, stop gauge 44 comprises a locking means that is defined by a flexible arm 58 which is provided with a latch member 59 having a shoulder 62. There is formed on each side of gauge 44 a pair of grooves 64 which correspond to a pair of parallel rail members 66 formed on each side of partition 32. Grooves 64 and rails 66 define a slide means which allows for each gauge to slide back and forth within compartment 30.

When gauge 44 is in an unlocked position as in FIG. 4, the front portion is extended. However, when gauge 44 is retracted as in FIG. 3, the front face of front portion 46 is slightly recessed within compartment 30, as indicated at 70. Accordingly, the distance from the front face to shoulder 62 of latch 59 is smaller than the width of housing 20. This arrangement allows for the cutting of individual workpieces. That is, when only one workpieces needs to be cut, it is pressed against the extended stop gauges. This forces the stop gauges inwardly without latch 59 locking to the rear edge of top wall 26.

It should be noted that table 12 is provided with a channel 72 that is wide enough to receive the bottom portion of fence housing 20. In FIG. 3 housing 20 is shown as being secured to table 12 and in channel 72 by a securing means defined by an elongated flange member 74 which includes a plurality of holes 76 whereby screws 78 are inserted to secure each calibrated fence unit in place.

Figure 7:
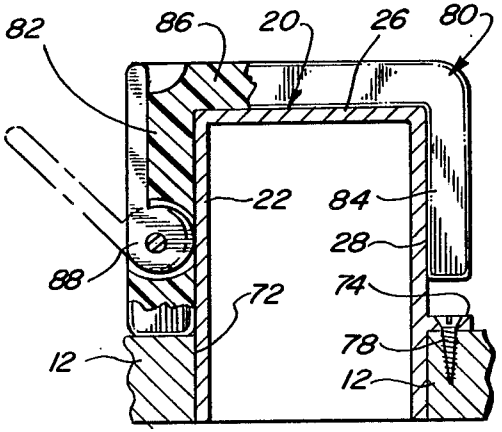
FIG. 7 is a cross-sectional view of the housing illustrating a clamp-type stop member used for measured fractional settings in between the half-inch marks as indicated along the fence housing.

When a workpiece requires a measurement that falls between the calibrated stop gauge members 44, a clamp member 80 is used as seen in FIG. 7. Clamp member 80 can be of various configurations, but the example as shown comprises an inverted substantially U-shaped body formed by front and rear leg members 82 and 84, respectively, and integrally supported by bridge member 86. This allows clamp 80 to be secured over housing 20 at any point along the length thereof.

It may be thus seen that the objects of the present invention set forth herein, as well as those made apparent from the foregoing description, are efficiently attained. While preferred embodiments of the invention have been set forth for purpose of disclosure, modifications of the disclosed embodiments of the invention, as well as other embodiments thereof, may occur to those skilled in the art. Accordingly, the appended claims are intended to cover all embodiments which do not depart from the spirit and scope of the invention.

What I claim is:

1. A calibrated fence apparatus for use with radial arm saws wherein the apparatus comprises:

at least one fence unit defined by an elongated housing wherein said housing is formed with a plurality of compartments therein;

gauge means slidably mounted in said housing whereby said gauge means is adjustable between an extended position and a retracted position, and comprises a plurality of stop gauge members that are slidably mounted within each compartment;

means for releasably locking said gauge means in a retracted position when setting said fence apparatus to cut a workpiece to a selected length;

means to limit the extended position of said gauge means; and means for securing said fence unit to a table top of the radial saw;

slide means positioned between said compartments and said stop gauge members; and biasing means interposed between said housing and said stop gauge members; and wherein said housing comprises:

a front wall;

a top wall;

a rear wall; and oppositely disposed end walls; and wherein said front and rear walls include vertical slots formed therein, said slots in said front and rear walls being positioned in alignment with each other and wherein said compartments are defined by a plurality of partitions disposed in said housing; wherein said slide means comprising:

a pair of parallel slide grooves formed on each side of said stop gauge members; and a pair of corresponding rail members formed on each side of said partition whereby said rail members are positioned within said respective grooves so that said stop gauge members slide horizontally back and forth with said compartment.

2. An apparatus as recited in claim 1, wherein said locking means comprises a flexible locking arm integrally formed with said stop gauge.

3. An apparatus as recited in claim 2, wherein said biasing means comprises a coil spring mounted between said stop gauge member and said rear wall of said housing.

4. An apparatus as recited in claim 3, wherein said securing means is defined by an elongated flange member formed along the rear wall of said housing and including a plurality of holes therein to receive a screw.

5. An apparatus as recited in claim 4, wherein said limit means is defined by a shoulder member positioned on said stop gauge member to engage said front wall of said housing.

6. An apparatus as recited in claim 5, including means for securing two or more of said fence units together.

7. An apparatus as recited in claim 6, wherein said securing means comprises at least one tongue member formed on one of said end walls of said housing and at least one groove member formed in the opposite end wall thereof.

8. An apparatus as recited in claim 7, wherein said apparatus includes a lockable clamp member to be secured on said housing to provide a fixed measurement between said stop gauge members.

9. An apparatus as recited in claim 8, wherein said housing includes means for selectively calibrating said lockable clamp member.

* * * * *